US011061422B2

(12) United States Patent
Jin

(10) Patent No.: US 11,061,422 B2
(45) Date of Patent: Jul. 13, 2021

(54) LOW DROPOUT LINEAR REGULATOR AND VOLTAGE STABILIZING METHOD THEREFOR

(71) Applicant: Chipone Technology (Beijing) Co., Ltd., Beijing (CN)

(72) Inventor: Ning Jin, Beijing (CN)

(73) Assignee: CHIPONE TECHNOLOGY (BEIJING) CO., LTD., Beijing (CN)

( * ) Notice: Subject to any disclaimer, the term of this patent is extended or adjusted under 35 U.S.C. 154(b) by 0 days.

(21) Appl. No.: 16/628,011

(22) PCT Filed: Jun. 12, 2019

(86) PCT No.: PCT/CN2019/090849
§ 371 (c)(1),
(2) Date: Dec. 31, 2019

(87) PCT Pub. No.: WO2020/001271
PCT Pub. Date: Jan. 2, 2020

(65) Prior Publication Data

US 2021/0026384 A1 Jan. 28, 2021

(30) Foreign Application Priority Data

Jun. 25, 2018 (CN) ..... 201810664170.8

(51) Int. Cl.
*G05F 1/575* (2006.01)
*G05F 1/59* (2006.01)

(52) U.S. Cl.
CPC ..... *G05F 1/575* (2013.01); *G05F 1/59* (2013.01)

(58) Field of Classification Search
CPC .. G05F 1/575; G05F 1/59; H02M 2001/0009; H02M 2001/0025
See application file for complete search history.

(56) References Cited

U.S. PATENT DOCUMENTS

2004/0008079 A1* 1/2004 Osamura ..... G05F 1/575 327/540
2015/0355653 A1* 12/2015 Drebinger ..... G05F 1/575 323/280

FOREIGN PATENT DOCUMENTS

CN 1484367 A 3/2004
CN 101562391 A 10/2009
(Continued)

*Primary Examiner* — Kyle J Moody
*Assistant Examiner* — Lakaisha Jackson
(74) *Attorney, Agent, or Firm* — Treasure IP Group, LLC

(57) ABSTRACT

Disclosed is a low dropout linear regulator and a voltage stabilizing method therefor in embodiments. The low dropout linear regulator includes: a drive circuit, generating a first control signal according to a voltage reference and a feedback voltage and generating an output current according to the first control signal, a load capacitor providing an output voltage according to the output current; a voltage feedback circuit, obtaining the feedback voltage according to the output voltage; a current feedback circuit, generating a second control signal according to the output current; a switch circuit, providing the voltage reference according to the second control signal. Among them, in a first phase of a startup process, the voltage reference is less than or equal to an initial value, and the current feedback circuit limits the output current according to the second control signal; in a second phase of the startup process, the switch circuit switches a voltage value of the voltage reference to a target value. The low dropout linear regulator and the voltage stabilizing method therefor of the embodiment of the disclosure, during the startup process, may effectively limit the output current and make the output voltage rise gently so as to reduce or avoid overshoot.

18 Claims, 5 Drawing Sheets

(56) References Cited

FOREIGN PATENT DOCUMENTS

| | | | | |
|---|---|---|---|---|
| CN | 101568893 | A | 10/2009 | |
| CN | 104181968 | A | 12/2014 | |
| CN | 207249522 | U | 4/2018 | |
| CN | 108919872 | A | 11/2018 | |
| CN | 208580347 | U | 3/2019 | |
| EP | 2120123 | | 11/2009 | |
| EP | 2120123 | A1 * | 11/2009 | ..... H03K 17/166 |

* cited by examiner

- Prior Art -

- Prior Art -

- Prior Art -

LOW DROPOUT LINEAR REGULATOR AND VOLTAGE STABILIZING METHOD THEREFOR

CROSS-REFERENCE TO RELATED APPLICATIONS

This application claims priority from Chinese Patent Application No. 201810664170.8, submitted to Patent Office of the People's Republic of China, filed on Monday, Jun. 25, 2018 and entitled by "Low Dropout Linear Regulator And Voltage Stabilizing Method Therefor", the entire contents of which are incorporated by reference in the present application.

FIELD OF TECHNOLOGY

The disclosure relates to the field of electronic circuit technology, in particular, to a low dropout linear regulator and a voltage stabilizing method therefor.

BACKGROUND

Low dropout linear regulator (LDO) is a widely used circuit in power supply systems to provide a stable output voltage Vout. Typically, the output voltage: Vout=Vdd−Vdrop, wherein Vdd represents the power supply voltage and Vdrop represents a voltage difference between the power supply voltage and the output voltage.

During the startup of the LDO, the LDO generates a charging current according to the voltage reference such that the output voltage Vout changes from 0V to a target voltage value. During the startup process, considering the lifetime, the drive capability, and the current characteristics of the internal circuit in the LDO, the output current of the LDO has to be limited to a certain range. When the output voltage Vout of LDO is close to the target voltage value, the output voltage of LDO will cause overshoot if the output current cannot quickly drop from a charging current value to a load current value. If an overshoot voltage caused by the overshoot is too large, subsequent load circuits connected to the LDO may have functional failure and overheat damage. Therefore, how to ensure that the output voltage of the LDO can reach the target voltage value smoothly during the startup process to avoid or slow down the overshoot of the output voltage is a subject worth studying.

FIG. 1 is a circuit diagram of a conventional low dropout linear regulator.

As shown in FIG. 1, the conventional low dropout linear regulator 1000 includes a differential amplifier OP0, a buffer unit 1100, a driving transistor Pbuf0, a voltage feedback unit 1200, and a load capacitor Cload and a load resistor Rload. Among them, a power supply terminal and a ground terminal of the differential amplifier OP0 receive a power supply voltage Vdd and a reference ground voltage Vgnd, respectively, and the differential amplifier OP0 generates a control signal V01 according to a difference between a voltage reference Vref0 and a feedback voltage Vfb0; the buff unit 1100 includes an N-channel transistor N0 and a P-channel transistor P0, the transistors N0 and P0 are connected to each other at a node A0, and a degree of conduction of the transistor N0 is controlled by a voltage value of the control signal V01, i.e., a degree to which a voltage V02 at the node A0 is pulled down is controlled by the control voltage V01, a control terminal of the transistor P0 being connected to the node A0; a control terminal of the driving transistor Pbuf0 and the control terminal of the transistor P0 are connected to each other at the node A0 to receive the voltage V02, so that the drive transistor Pbuf0 may generate an output current Tout according to the voltage V02; the output current Tout acts on the load capacitor Cload, so as to generate an output voltage Vout; the voltage feedback unit 1200 samples the output voltage Vout by using voltage dividing resistors R01 and R02 to obtain a feedback voltage Vfb0 for characterizing the output voltage.

The conventional low dropout linear regulator 1000 implements a startup process of the output voltage Vout and a voltage stabilizing process through a voltage feedback loop. As shown in FIG. 1, when the output voltage Vout does not reach a target voltage value corresponding to the voltage reference Vref0, the feedback voltage Vfb0 is lower than the voltage reference Vref0, thus the control signal V01 turns on the transistor N0, thereby lowering the voltage V02 at the node A0, so that the driving transistor Pbuf0 generates a larger output current Tout to continue charging the load capacitor Cload to realizing the purpose of raising the output voltage Vout until the output voltage Vout reaches the target voltage value corresponding to the voltage reference Vref0.

FIG. 2 shows waveform diagrams of a voltage reference Vref0 and an output voltage Vout of the low dropout linear regulator during the startup process in FIG. 1.

As shown in FIGS. 1 and 2, during the startup process, the voltage reference Vref0 instantaneously rises from an initial low level voltage (for example, 0V) to a target value vref0_tg, so that the voltage reference Vref0 is much higher than the feedback voltage Vfb0, thus a difference between the voltage reference Vref0 input to the differential amplifier OP0 and the feedback voltage Vfb0 is large, which causes the control voltage V01 to approach a maximum value within a swing range of the output voltage of the differential amplifier OP1 and the voltage V02 at node A0 to be pulled down to a very low voltage level, thereby making the driving transistor Pbuf0 to be in an almost fully turn-on state, at which time a current value Ich (charging current value) of the output current Tout is much higher than a current value Ist (load current value) of the output current Tout supplied by the low dropout linear regulator 1000 during the voltage stabilizing process.

Therefore, the conventional low dropout linear regulator 1000 has the following drawbacks: during the startup process, since the voltage reference Vref0 rises instantaneously to the target value vref0_tg, the output current Tout instantaneously reaches a very high current value Ich, which may shorten the service time of the driving transistor Pbuf0, and the traces of the conductors in the layout are required to have a certain width, causing an increase in layout area and increase in difficulty for layout routing; at the same time, during the startup process, when the output voltage Vout is close to the target voltage value vout_tg, the low dropout linear regulator needs to restore the current value of the output current Tout from a very high current value Ich to a lower current value Ist, which may cause the output voltage Vout to be higher than the target voltage value for a period of time, i.e., causing overshoot, since the voltage feedback loop requires a certain response time, then load circuits for latter stages connected to the low dropout linear regulator are affected when the output voltage Vout has a large overshoot voltage v_overshoot as compared with the target voltage value vout_tg.

n view of the above drawbacks, a prior art has improved the above conventional low dropout linear regulator. FIG. 3 shows waveform diagrams of a voltage reference and an output voltage in the prior art low dropout linear regulator.

As shown in FIG. 3, during the startup process, the voltage reference Vref0 may not directly rise from a low level voltage to the target value vref0_tg, but gradually rises from the low level voltage to the target value vref0_tg, so as to prevent the output current Tout from being too high during the startup process. Further, since the output current Tout is limited, the time required for the output current Tout to return to the load current value is short when the output voltage Vout is close to the target voltage value vout_tg. Therefore, the prior art can alleviate the overshoot of the output voltage Vout to some extent.

However, as shown in FIG. 3, the overshoot of the output voltage is still present in the low dropout linear regulator provided by the prior art described above.

Therefore, a new low dropout linear regulator is expected, which can limit the magnitude of the output current during the startup process and effectively prevent the output voltage from overshooting, so that the output voltage can rise gently and steadily to the target voltage value during the startup process.

SUMMARY

In order to solve the problems in the prior art, in the present disclosure, by setting a switch circuit to achieve automatic switching between the current feedback loop and the voltage feedback loop, and by setting voltage references with different voltage values at different stages of the startup process to limit the magnitude of the output current, the output current is prevented from rising instantaneously and the output voltage is effectively prevented from overshooting, so that the output voltage may rise gently and steadily to the target voltage value during the startup process.

According to an aspect of the disclosure, a low dropout linear regulator is provided, including: a drive circuit, generating a first control signal according to a voltage reference and a feedback voltage and generating an output current according to the first control signal, a load capacitor providing an output voltage according to the output current; a voltage feedback circuit, obtaining the feedback voltage according to the output voltage; a current feedback circuit, generating a second control signal according to the output current; and a switch circuit, configured to provide the voltage reference according to the second control signal, wherein a startup process of the low dropout linear regulator includes a first phase and a second phase; in the first phase, the voltage reference is less than or equal to an initial value, and the current feedback circuit adjusts the first control signal according to the second control signal to limit the output current; in the second phase, the switch circuit switches a voltage value of the voltage reference to a target value according to the second control signal, the initial value being less than the target value.

Preferably, in the drive circuit, the output current increases as a voltage of the first control signal increases.

Preferably, the current feedback circuit includes a first transistor; the first transistor is configured to provide a first current path between the first control signal and a reference ground, and a control terminal of the first transistor receives the second control signal; in the first phase, a degree of conduction of the first transistor is controlled by the second control signal to adjust the first control signal, and in the second phase, the first transistor is turned off by the second control signal.

Preferably, the first transistor includes a P-channel transistor.

Preferably, the current feedback circuit further includes a current source; when a voltage value of the feedback voltage rises to the initial value, the current source provides a charging current to the control terminal of the first transistor to raise the second control signal to a high level state.

Preferably, the switch circuit includes: a first switch and a second switch, a first terminal of the first switch and a second terminal of the second switch respectively receiving a first reference voltage and a second reference voltage, a second end of the first switch being connected to a second end of the second switch to provide the voltage reference, a voltage value of the first reference voltage and a voltage value of the second reference voltage being respectively equal to the initial value and the target value; and a logic circuit, controlling the first switch and the second switch to be turned on and off according to the second control signal, wherein when the second control signal is in a low level state, the first switch is turned on and the second switch is turned off, and when the second control signal is in a high level state, the second switch is turned on and the first switch is turned off.

Preferably, the logic circuit includes: a latch, configured to generate a switch control signal according to an enable signal and a level state of the second control signal, wherein when the enable signal is active, one of the first switch and the second switch is turned on under the control of the switch control signal.

Preferably, the low dropout linear regulator further includes a reset circuit including: a hold capacitor, having a first end connected to the reference ground and a second end connected to the control terminal of the first transistor; and a reset transistor, turned on when the enable signal is inactive to short the first terminal and the second terminal of the hold capacitor.

Preferably, the current feedback circuit further includes: a second transistor, configured to sample the output current to obtain a sampling current; and a third transistor, configured to provide a second current path between the second control signal and the reference ground, wherein a control terminal of the third transistor generates a sampling voltage according to the sampling current to cause a degree of conduction of the third transistor to be controlled by the sampling voltage.

Preferably, the second transistor includes a P-channel transistor, and the third transistor includes an N-channel transistor.

Preferably, the drive circuit includes: a differential amplifier, generating the first control signal according to a difference between the voltage reference and the feedback voltage; a buffer unit, including at least a fourth transistor and a fifth transistor, a gate of the fifth transistor receiving a third control signal, the fourth transistor being configured to provide a third current path between the third control signal and the reference ground, a degree of conduction of the fourth transistor being controlled by the first control signal to adjust the third control signal; and a drive transistor, generating the output current according to the third control signal.

Preferably, the fourth transistor includes an N-channel transistor, and the fifth transistor includes a P-channel transistor.

Preferably, the voltage feedback circuit includes a plurality of sampling resistors connected in series, and the plurality of sampling resistors are configured to divide the output voltage to obtain the feedback voltage.

According to another aspect of the disclosure, a voltage stabilizing method for a low dropout linear regulator is provided, including: generating a first control signal based on a voltage reference and a feedback voltage; generating an output current according to the first control signal; providing an output voltage according to the output current; providing a voltage feedback loop to obtain the feedback voltage according to the output voltage; providing a current feedback loop to generate a second control signal according to the output current; and providing the voltage reference according to the second control signal, wherein a startup process of the low dropout linear regulator includes a first phase and a second phase; in the first phase, the current feedback loop is initiated, a voltage value of the voltage reference is set to be less than or equal to an initial value, and the first control signal is adjusted according to the second control signal to limit the output current; in the second phase, the current feedback loop is gradually turned off, and a voltage value of the voltage reference is switched to a target value according to the second control signal, the initial value being less than the target value.

Preferably, in the drive circuit, the output current is set to increase as a voltage of the first control signal raises.

Preferably, the step of adjusting the first control signal according to the second control signal to limit the output current includes: in the first phase, providing a first current path between the first control signal and a reference ground, and controlling a degree of conduction of the first current path according to the second control signal to adjust a voltage of the first control signal; in the second phase, turning off the first current path according to the second control signal.

Preferably, the step of switching a voltage value of the voltage reference to a target value according to the second control signal includes: providing a charging current to raise the second control signal to a high level state when a voltage value of the feedback voltage rises to the initial value; setting the voltage reference to be equal to the initial value when the second control signal is in a low level state, and setting the voltage reference to be equal to the target value when the second control signal is in a high level state.

Preferably, the voltage stabilizing method further includes: providing an enable signal; resetting the second control signal to be in a low level state when the enable signal is inactive.

Preferably, the step of generating a second control signal according to the output current includes: sampling the output current to obtain a sampling current, and obtaining a sampling voltage according to the sampling current; providing a second current path between the second control signal and the reference ground, a degree of conduction of the second current path being controlled by the sampling voltage.

Preferably, the step of obtaining the feedback voltage according to the output voltage includes: dividing the output voltage to obtain the feedback voltage for characterizing the output voltage.

In each embodiment of the disclosure, by first providing a voltage reference less than or equal to an initial value during the startup process, and operating the low dropout linear regulator in current feedback mode, the low dropout linear regulator and the voltage stabilizing method limit the output current to prevent the output current from being too high and affect the load circuits in latter stages; at the same time, during the startup process, when the output voltage reaches a preset voltage value that is slightly lower than the target voltage value, the low dropout linear regulator and the voltage stabilizing method in each embodiment of the disclosure may be automatically switched to the voltage feedback mode by current feedback mode, and since the preset voltage value is close to the target voltage value, the output current generated by the low dropout linear regulator during the switching from the current feedback mode to the voltage feedback mode is limited, and the output voltage may gently rise from the preset voltage value to the target voltage value, so that the overshoot amplitude of the output voltage during the startup process is effectively controlled, and the load circuits in latter stages are prevented from being affected by the overshoot of the output voltage.

BRIEF DESCRIPTION OF THE DRAWINGS

The above and other objects, features and advantages of the present disclosure will become more apparent from the description below with reference to the accompanying drawings.

DESCRIPTION OF THE EMBODIMENTS

Figure 1:
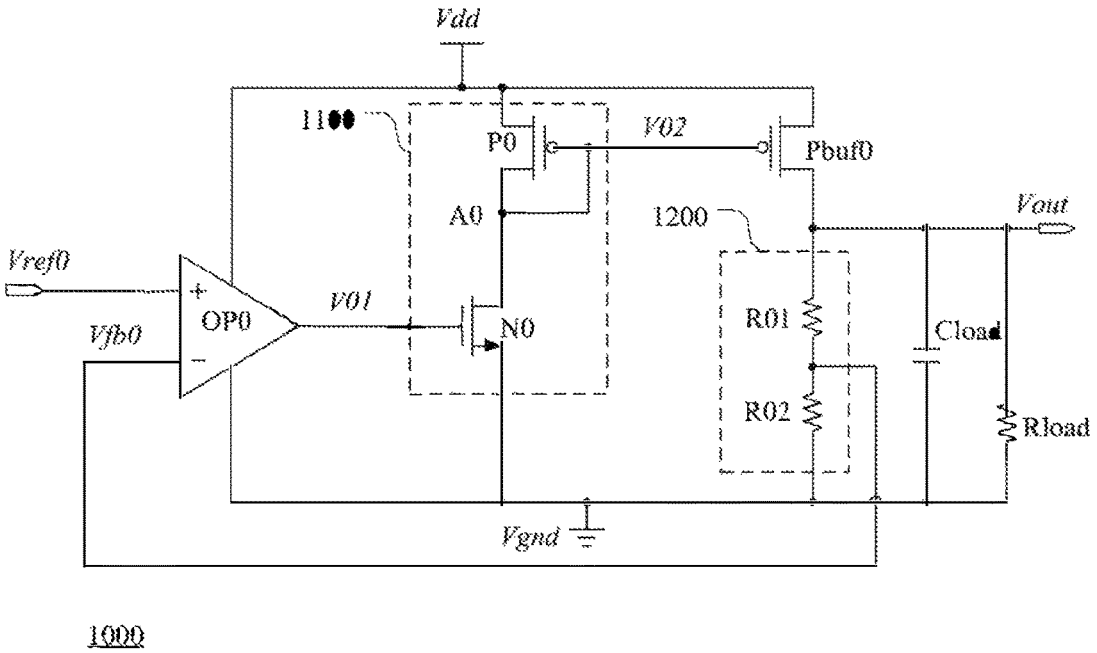
FIG. 1 is a circuit diagram of a conventional low dropout linear regulator.
Figure 2:
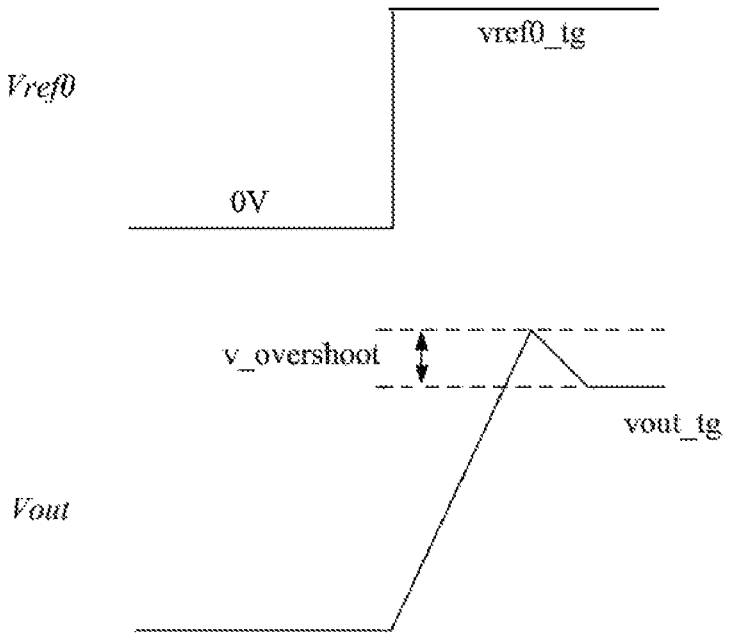
FIG. 2 shows waveform diagrams of a voltage reference Vref0 and an output voltage Vout of the low dropout linear regulator during the startup process in FIG. 1.
Figure 3:
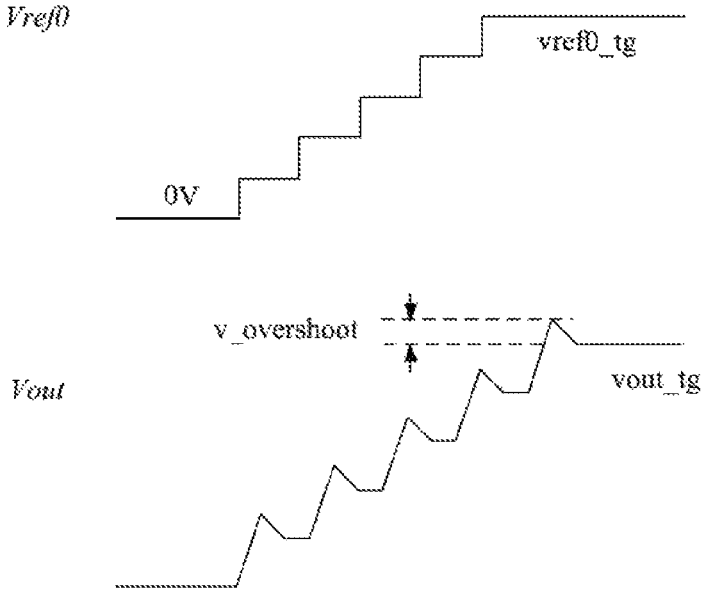
FIG. 3 shows waveform diagrams of a voltage reference and an output voltage in the prior art low dropout linear regulator.

The present disclosure will be described in more detail below with reference to the accompanying drawings. In the various figures, the same elements are denoted by the similar reference numerals. For the sake of clarity, the various parts in the figures are not drawn to scale. Further, the lead wires other than the corresponding driving electrodes and the sensing electrodes are not shown in the drawings, and some well-known portions may not be shown.

Many specific details of the disclosure are described below, such as the structure, materials, dimensions, processing, and techniques of the disclosure, in order to provide a clear understanding of the disclosure. However, as will be understood by those skilled in the art, the disclosure may not be implemented in accordance with these specific details.

Figure 4:
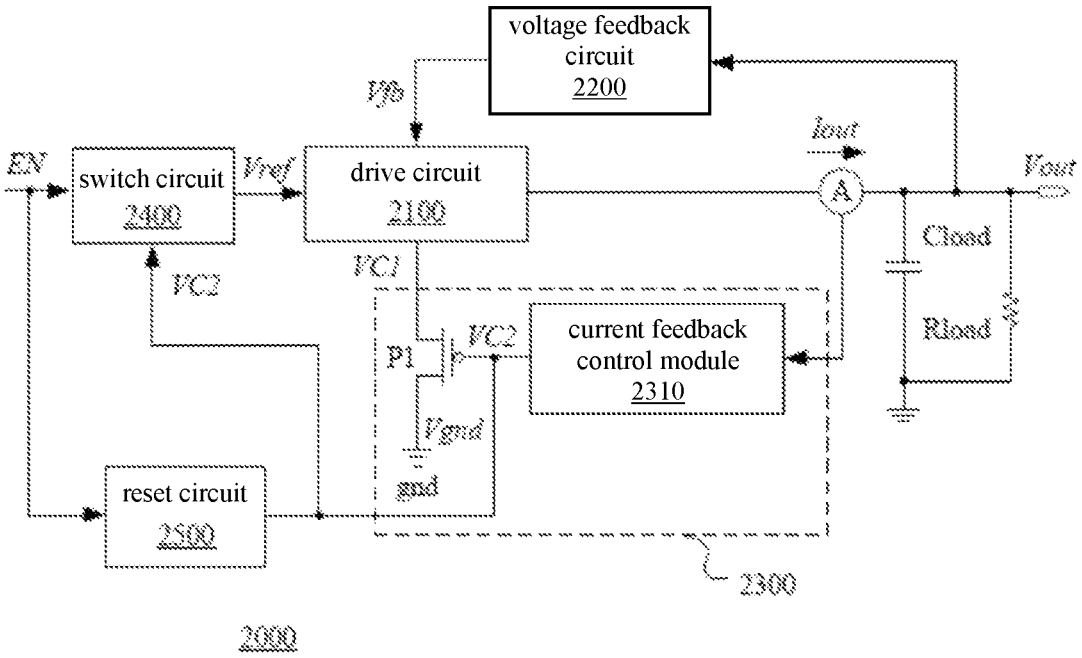
FIG. 4 shows a circuit diagram of a low dropout linear regulator of a first embodiment of the disclosure.

FIG. 4 shows a circuit diagram of a low dropout linear regulator of a first embodiment of the disclosure.

As shown in FIG. 4, the low dropout linear regulator 2000 of a first embodiment of the disclosure includes a drive circuit 2100, a voltage feedback circuit 2200, a current feedback circuit 2300, a switch circuit 2400 and a reset circuit 2500.

The drive circuit 2100 generates a first control signal VC1 according to a voltage reference Vref and a feedback voltage Vfb, and generates an output current Tout according to the first control signal VC1. A load capacitor Cload connected to the drive circuit 2100 receives the output current Tout, thereby generating an output voltage Vout according to the output current Tout, and the output voltage Vout is applied to a load resistor Rload (for example, the equivalent resistors of load circuits of the latter stages).

The voltage feedback circuit 2200 is configured to obtain a feedback voltage Vfb according to the output voltage Vout, and supply the feedback voltage Vfb to the drive circuit 2100, thereby forming a voltage feedback loop with the drive circuit 2100.

The current feedback circuit 2300 includes a transistor P1 and a current feedback control module 2310. Among them, the current feedback control module 2310 is configured to generate a second control signal VC2 according to the output current Tout; a control terminal of the transistor P1 is controlled by the second control signal VC2, and a first terminal and a second terminal of the transistor P1 are connected to the drive circuit 2100 and a reference ground gnd (providing a reference ground voltage Vgnd), respectively, so that the transistor P1 may provide a current path between the first control signal VC1 and the reference ground gnd. Since a degree of conduction of the transistor P1 is controlled by the second control signal VC2, the first control signal VC1 may be adjusted such that the current feedback circuit 2300 forms a current feedback loop with the drive circuit 2100.

The switch circuit 2400 is configured to provide a voltage reference Vref according to the second control signal VC2. The reference voltage Vref provided by the switch circuit 2400 has a different voltage value according to a level state of the second control signal V02.

Preferably, the low dropout linear regulator 2000 further includes a reset circuit 2500. The reset circuit 2500 is controlled by an enable signal EN. Before the low dropout linear regulator 2000 starts, the enable signal EN is inactive, and the reset circuit 2500 resets the second control signal VC2, so that the transistor P1 in the current feedback circuit 2300 is turned on, thereby further resetting the first control signal VC1; when the low dropout linear regulator 2000 starts, the enable signal EN is changed from inactive to active, and the current feedback circuit 2300 adjusts the second control signal VC2 according to the output current Tout, so that the drive circuit 2100 mainly works in the current feedback loop in a first stage of the startup process; further preferably, the switch circuit 2400 is also controlled by the enable signal EN, and the switch circuit 2400 selects a voltage value of the voltage reference Vref according to the enable signal EN and the level state of the second control signal VC2.

Figure 5:
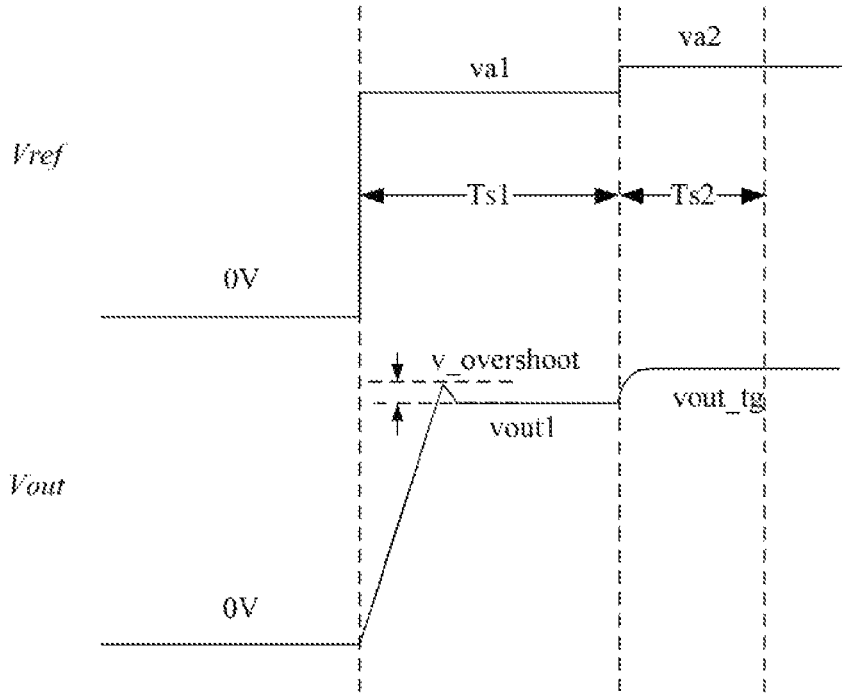
FIG. 5 shows waveform diagrams of a voltage reference and an output voltage of the low dropout linear regulator during the startup process in FIG. 4.

FIG. 5 shows waveform diagrams of a voltage reference and an output voltage of the low dropout linear regulator during the startup process in FIG. 4.

As shown in FIGS. 4 and 5, a working process of the low dropout linear regulator 2000 includes a startup process (from when the power-on/enable signal EN changes from inactive to active to when the output voltage Vout reaches the target voltage vout_tg) and a stabilizing process (when the output voltage Vout maintains at the target voltage vout_tg). Specifically, a startup process includes a first phase Ts1 and a second phase Ts2: the drive circuit 2100 mainly works in a current feedback loop, that is, the current feedback circuit 2300 adjusts the first control signal VC1 according to the second control signal VC2 to limit the amplitude of the output current Tout (the output current Tout is constant or approximately constant) such that the output voltage Vout is smoothly raised to avoid the overshoot with a large amplitude of the output voltage Vout, then the voltage value of the voltage reference Vref provided by the switch circuit 2400 is equal to the initial value va1, and at the end of the first phase, the output voltage Vout may eventually be regulated at a preset voltage value vout1 corresponding to the initial value va1 of the voltage reference; in the second phase Ts2, the second control signal VC2 provided by the current feedback circuit 2300 gradually changes from the first level state to the second level state such that the transistor P1 is gradually turned off and the switch circuit 2400 switches the voltage value of the voltage reference Vref to a target value va2 by the second control signal VC2 so as to make the drive circuit 2100 mainly work in the voltage feedback loop, that is, the drive circuit 2100 adjusts the output voltage Vout mainly according to a difference between the feedback voltage Vfb and the voltage reference Vref provided by the voltage feedback circuit 2200, and in the second phase, the output voltage Vout is raised from the preset voltage value vout1 to the target voltage value vout_tg. Since the output current Tout is limited in the first stage Ts1, the load capacitor Cout is approximately charged by a constant current, so the output voltage Vout has a smaller amplitude of an overshoot voltage v_overshoot due to the overshoot; in the second phase Ts2, setting the difference between the initial value va1 of the voltage reference Vref and the target value va2 to be slightly greater than or equal to the amplitude of the overshoot voltage v_overshoot may cause the driving ability of the first control signal VC1 to be weak, so the output voltage Vout may be gently raised from the preset voltage value vout1 to the target voltage value vout_tg, thereby avoiding the overshoot of the output voltage Vout in the second stage.

Figure 6:
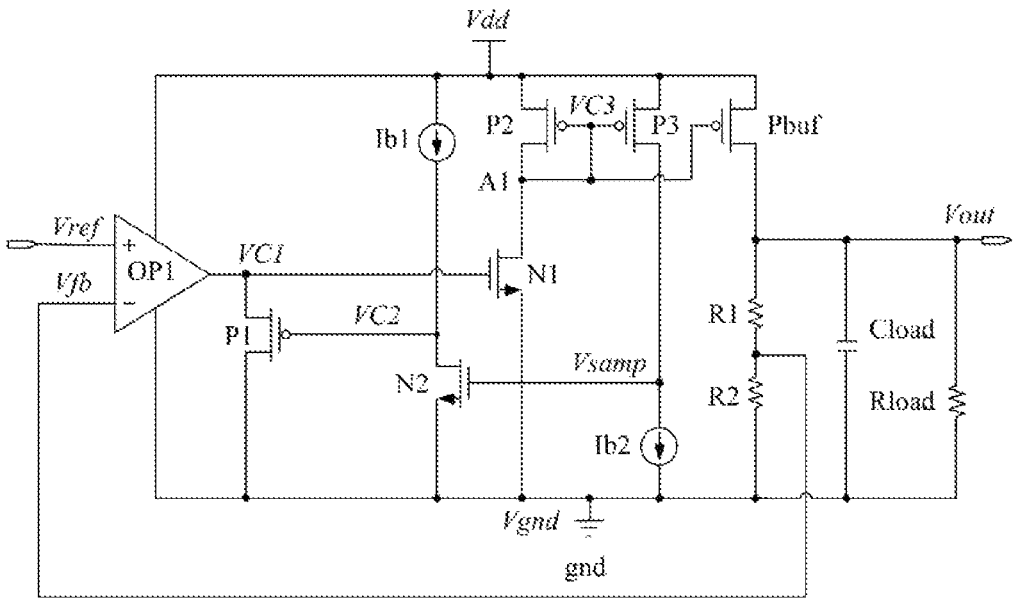
FIG. 6 shows specific circuit diagrams of a drive circuit, a current feedback circuit, and a voltage feedback circuit in a low dropout linear regulator in FIG. 4.

FIG. 6 shows specific circuit diagrams of a drive circuit, a current feedback circuit, and a voltage feedback circuit in a low dropout linear regulator in FIG. 4.

As shown in FIG. 6, the drive circuit (drive circuit 2100 shown in FIG. 4) includes a differential amplifier OP1, a buff unit and a drive transistor Pbuf, wherein the buff unit includes a transistor N1 and a transisitor P2. Specifically, the differential amplifier OP1 generates the first control signal VC1 according to a difference between the voltage reference Vref and the feedback voltage Vfb, and a power supply terminal, a ground terminal, a positive input terminal and a negative input terminal of the differential amplifier OP1 receive the power supply voltage Vdd, the reference ground voltage Vgnd, the voltage reference Vref and the feedback voltage Vfb, respectively; a control terminal of the transistor N1 is connected to an output terminal of the differential amplifier OP1, a first terminal of the transistor N1 and a first terminal of the transistor P2 are connected to each other at the node A1, a second terminal of the transistor N1 is connected to the reference ground gnd, a control terminal of the transistor P2 is controlled by a voltage VC3 of the node A1 (third control signal), and a second terminal of the transistor P2 is connected to the power supply voltage Vdd; a control terminal of the drive transistor Pbuf is also controlled by the voltage VC3 of the node A1, a first terminal of the drive transistor Pbuf is connected to the power supply voltage Vdd, and a second terminal provides the output current Tout to a first terminal of the load capacitor Cload, so that the output voltage Vout is generated at the first terminal of the load capacitor Cload, and a second terminal of the load capacitor Cload is connected to the reference ground gnd.

As shown in FIG. 6, the voltage feedback circuit 2200 includes a plurality of sampling resistors, thereby obtaining the feedback voltage Vfb capable of characterizing the output voltage Vout by dividing the output voltage Vout. For example, the voltage feedback circuit 2200 includes sampling resistors R1 and R2 connected in series between the output voltage Vout and the reference ground gnd, and a node connected between the sampling resistors R1 and R2 is connected to one of input terminals of the differential amplifier OP1 in the drive circuit 2100 to provide the feedback voltage Vfb.

As shown in FIG. 6, the current feedback circuit 2300 includes a transistor P1 and a current feedback control module. As a specific embodiment, the current feedback control module includes transistors N2 and P3, a current drain Ib2, and a current source Ib1. Among them, a control terminal and a first terminal of the transistor P3 are respectively connected to a control terminal and a first terminal of the drive transistor Pbuf, so that a ratio of an on current of the transistor P3 to the output current Tout provided by the drive transistor Pbuf is positively correlated with a ratio of a size of the transistor P3 to a size of the drive transistor Pbuf, thereby making the transistor P3 realize sampling of the output current Tout, and the current drain Ib2 is connected between a second terminal of the transistor P3 and the reference ground gnd while a second terminal of the transistor P3 providing a sampling voltage Vsamp; the transistor N2 has a control terminal receiving the sampling voltage Vsamp, a first terminal connected to the ground gnd and a second terminal connected to the control terminal of the transistor P1, so as to provide the second control signal VC2; the current source Ib1 is connected between the power supply voltage Vdd and the second terminal of the transistor N2 to transition the second control signal VC2 from the first level state to the second level state during the startup process.

As a specific embodiment, in FIG. 6, the transistors N1 and N2 are N-channel transistors, and the transistors P2 and P3 and the drive transistor Pbuf are P-channel transistors. The structure and operation principle of the low dropout linear regulator 2000 will be described below based on this, but the embodiment of the present disclosure is not limited thereto. Those skilled in the art may set the transistors N1, P2 and the drive transistor Pbuf to different types of transistors according to actual needs, and adaptively adjust the related circuits to implement alternative embodiments of the disclosure.

In the first phase of the startup process, the drive circuit 2100 mainly works in the current feedback loop, and when the output current Tout exceeds a certain value, the larger the output current Tout, the larger the on current provided by the transistor P3, the higher the sampling voltage Vsamp, the higher the degree of conduction of the transistor N2, and the stronger the pull-down capability, and also the lower the voltage of the second control signal VC2, the higher the degree of conduction of the transistor P1, and the stronger the pull-down capability, so that the lower the voltage of the first control signal VC1 is, the smaller the degree of conduction of the transistor N1 is, and the weaker the pull-down capability is, and the higher the voltage VC3 of the node A1 is, the smaller the degree of conduction of the drive transistor Pbuf is, thus the output current Tout is lowered According to such a principle, the current feedback loop may limit the output current Tout generated by the drive circuit 2100 within a certain range, so that the output current remains substantially constant during the first phase of the startup process, and the output voltage Vout may rise smoothly, thereby avoiding excessive overshoot voltage.

In the second phase of the startup process, the drive circuit 2100 mainly operates in the voltage feedback loop, and the greater the difference between the voltage reference Vref and the feedback voltage Vfb, the higher the voltage of the first control signal VC1, the higher the degree of conduction of the transistor N1, the stronger the pull-down capability, so that the lower the voltage VC3 of the node A1, the higher the degree of conduction of the drive transistor Pbuf, and further the larger the output current Tout, then the voltage value of the output voltage Vout rises until the feedback voltage Vfb reaches the voltage reference Vref at this time.

Figure 7:
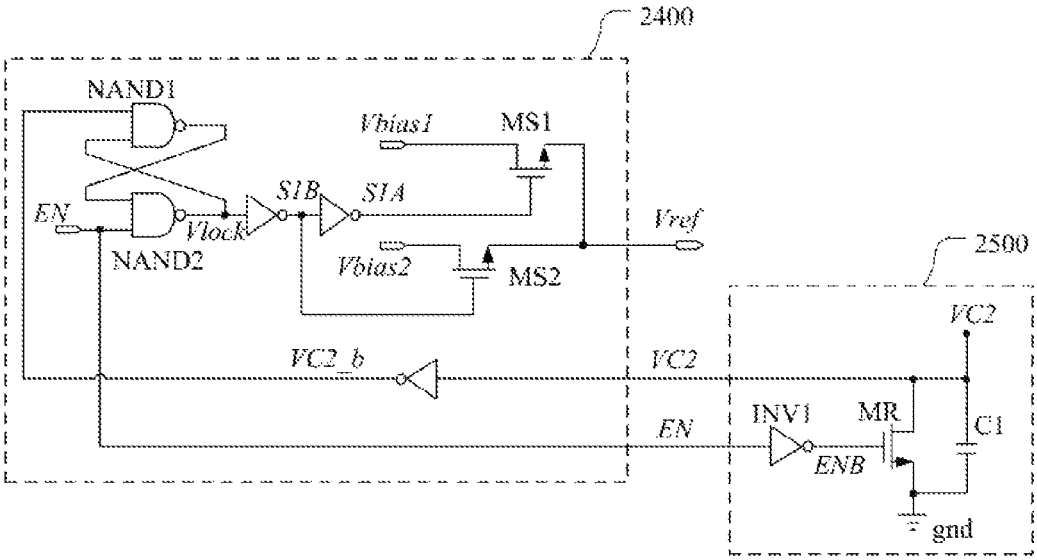
FIG. 7 shows specific circuit diagrams of a switch circuit and a reset circuit in a low dropout linear regulator in FIG. 4.

FIG. 7 shows specific circuit diagrams of a swithc circuit and a reset circuit in a low dropout linear regulator in FIG. 4.

As shown in FIG. 7, the reset circuit 2500 includes a hold capacitor C1, a reset transistor MR and at least one inverter. Among them, the hold capacitor C1 has a first terminal connected to the reference ground gnd, and a second end connected to the control terminal of the transistor P1, so as to adjust the second control voltage VC2; the reset transistor MR is connected in parallel with the holding capacitor C1, and a control terminal of the reset transistor MR receives the enable signal EN through at least one inverter, so that the reset transistor MR is controlled by an inverted signal ENB of the enable signal.

When the enable signal EN is active, the low dropout linear regulator 2000 is turned on, and the inverted signal ENB of the enable signal turns off the reset transistor MR. In the first phase of the startup process, the hold capacitor C1 provides the second control signal VC2 under the action of the transistor N2 and the current source Ib1; in the second phase of the startup process, the transistor N2 is gradually turned off, and the hold capacitor C1 is charged by the current source Ib1 to change the second control signal VC2 from the low level state to the high level state, so that the transistor P1 is turned off, and the low dropout linear regulator 2000 is switched from the current feedback mode to the voltage feedback mode. Preferably, a time for the current source Ib1 to charge the hold capacitor C1 may be preset, thereby ensuring that the low dropout linear regulator 2000 may be completely switched from the current feedback mode to the voltage feedback mode.

When the enable signal EN is inactive, the low dropout linear regulator 2000 is turned off, and the inverted signal ENB of the enable signal turns on the reset transistor MR, so that the hold capacitor C1 is discharged, thereby resetting the second control signal VC2 to a low level state close to the reference ground voltage Vgnd. Therefore, when the low dropout linear regulator 2000 is turned on again, the second control signal VC2 has an initial voltage close to the reference ground voltage Vgnd, and the transistor P1 is turned on to cause the drive circuit 2100 to operate mainly in the current feedback loop.

Preferably, the reset transistor MR is a N-channel transistor.

As shown in FIG. 7, the switch circuit 2400 includes a latch, switches MS1 and MS2, and a plurality of inverters.

Specifically, the latch includes, for example, NAND gates NAND1 and NAND2, wherein the NAND gate NAND1 has a first input terminal obtaining an inverted signal VC2_b of the second control signal VC2 through an odd number of inverters, and a second input terminal connected to an output terminal of the NAND gate NAND2 to receive a latch signal Vlock; the NAND gate NAND2 has a first input terminal receiving the enable signal EN, and a second input terminal connected to an output terminal of the NAND gate NAND1.

A first terminal of the switch MS1 and a first terminal of the switch MS2 receive a first reference voltage Vbias1 and a second reference voltage Vbias2, respectively, and a second terminal of the switch MS1 is connected to a second terminal of the switch MS2 to provide a reference voltage Vref; a control terminal of the switch MS1 receives the latch signal Vlock or obtains a buffer signal S1A of the latch signal Vlock through an even number of inverters connected in series, and a control terminal of the switch MS2 obtains an inverted signal S1B of the latch signal Vlock through an odd number of inverters connected in series. Among them, voltage values of the first reference voltage Vbias1 and the second reference voltage Vbias2 are respectively equal to the initial value va1 of the voltage reference Vref and the target value va2. Specifically, the switch MS1 and the switch MS2 may be realized by a device or circuit having a switching function such as a transistor or a transmission gate.

In the first phase of the startup process, the enable signal EN is active and the second control signal VC2 is close to the low level state, then the latch signal Vlock is regulated in the first state, the switch MS1 is turned on and the switch MS2 is turned off, so that the switch MS1 outputs the first reference voltage Vbias1 as the voltage reference Vref such that the voltage reference Vref has the initial value va1.

In the second phase of the startup process, the enable signal EN is active and the second control signal VC2 is close to the high level state, then the latch signal Vlock is regulated in the second state, the switch MS1 is turned off and the switch MS2 is turned on, so that the switch MS2 outputs the second reference voltage Vbias2 as the voltage reference Vref such that the voltage reference Vref has the target value va2.

In a preferred embodiment, a difference between the first reference voltage Vbias1 and the second reference voltage Vbias2 is equal to or slightly larger than the overshoot voltage v_overshoot of the load capacitor Cout during the first phase of the startup process. Since the amplitude of the overshoot voltage v_overshoot is small, the voltage value of the output voltage Vout during the startup process may not exceed the target voltage value vout_tg, that is, the output voltage Vout may rise gently to the target voltage value vout_tg during the startup process, thereby avoiding excessive output voltage Vout due to overshoot in the load circuits of latter stages, and ensuring that the load circuits of latter stages may work normally and is not damaged. In a specific embodiment, the difference between the first reference voltage Vbias1 and the second reference voltage Vbias2 is, for example, 10 mV.

In above embodiments, the voltage reference Vref is equal to the initial value in the first phase of the startup process, however the embodiments of the disclosure are not limited thereto; the voltage reference Vref may have different voltage values less than or equal to the initial value in the first phase of the startup process, and the switch circuit 2400 correspondingly implements switching between different voltage values, so that the voltage value of the output voltage Vout may rise stepwise in the first phase of the startup process.

In the first embodiment of the disclosure, by first providing a voltage reference less than or equal to an initial value during the startup process, and operating the low dropout linear regulator in current feedback mode, the low dropout linear regulator limits the output current to prevent the output current from being too high and affect the load circuits in latter stages; at the same time, during the startup process, when the output voltage reaches a preset voltage value that is slightly lower than the target voltage value, the low dropout linear regulator in the first embodiment of the disclosure may be automatically switched to the voltage feedback mode by current feedback mode, and since the preset voltage value is close to the target voltage value, the output current generated by the low dropout linear regulator during the switching from the current feedback mode to the voltage feedback mode is limited, and the output voltage may gently rise from the preset voltage value to the target voltage value, so that the overshoot amplitude of the output voltage during the startup process is effectively controlled, and the load circuits in latter stages are prevented from being affected by the overshoot of the output voltage.

Figure 8:
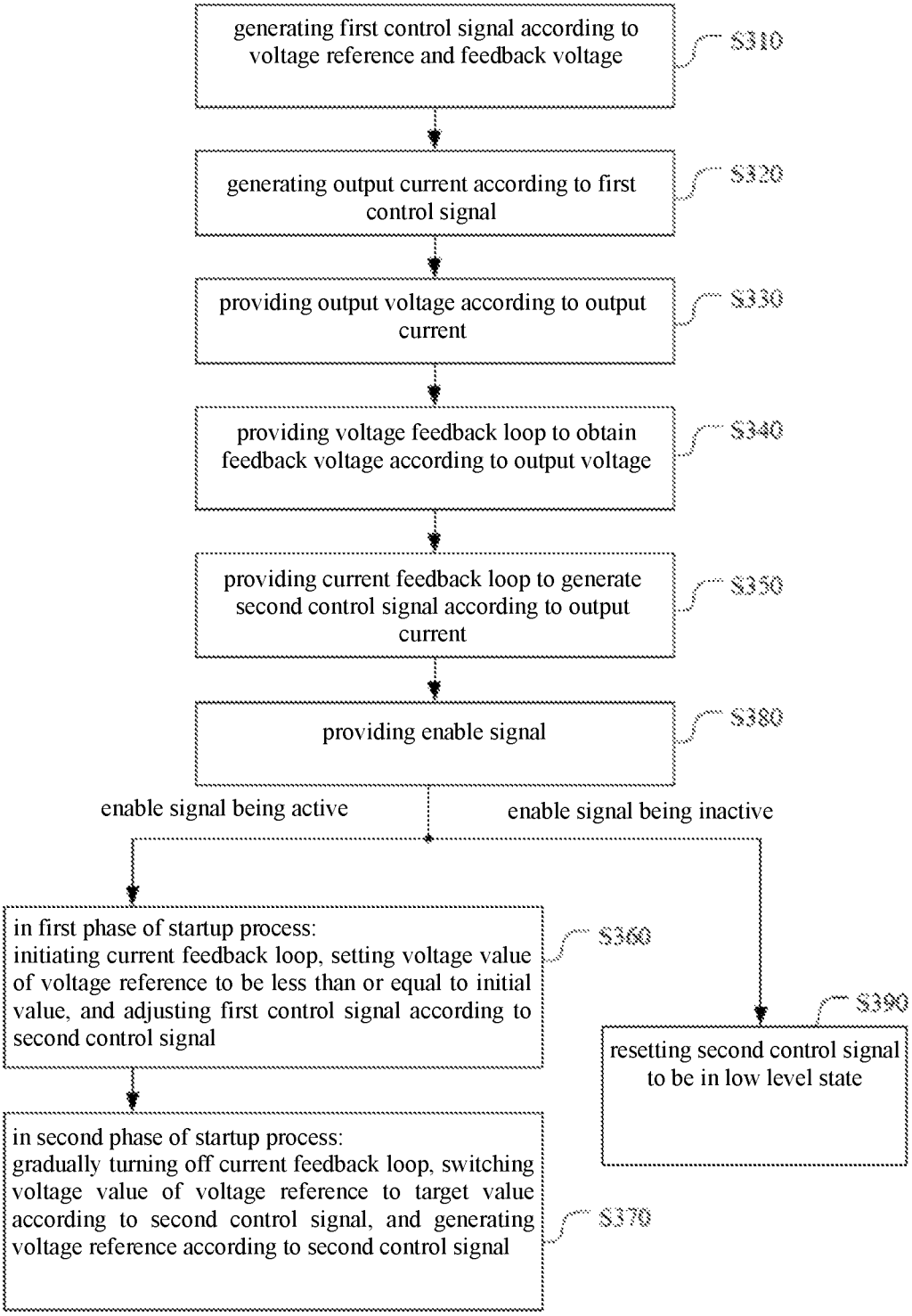
FIG. 8 shows a flow chart of a voltage stabilizing method for a low dropout linear regulator of a second embodiment of the disclosure.

FIG. 8 shows a flow chart of a voltage stabilizing method for a low dropout linear regulator of a second embodiment of the disclosure. The method includes steps S310 through S390.

Step S310: generating a first control signal based on a voltage reference and a feedback voltage; specifically, generating a first control signal according to a difference between a voltage reference and a feedback voltage.

Step S320: generating an output current according to the first control signal; preferably, setting the output current to increase as a voltage of the first control signal raises.

Step S330: providing an output voltage according to the output current.

Step S340: providing a voltage feedback loop to obtain the feedback voltage according to the output voltage; preferably, dividing the output voltage to obtain the feedback voltage for characterizing the output voltage.

Step S350: providing a current feedback loop to generate a second control signal according to the output current; preferably, sampling the output current to obtain a sampling current, and obtaining a sampling voltage according to the sampling current; providing a second current path between the second control signal and the reference ground, a degree of conduction of the second current path being controlled by the sampling voltage to adjust the second control signal.

S360: in the first phase of the startup process of the low dropout linear regulator, initiating the current feedback loop, setting a voltage value of the voltage reference to be less than or equal to the initial value (the initial value is less than the target value), and adjusting the first control signal according to the second control signal to limit the output current; preferably, in the first phase, providing a first current path between the first control signal and a reference ground (the first current path is turned off by the second control signal during the second phase of the startup process), and controlling a degree of conduction of the first current path according to the second control signal to adjust a voltage of the first control signal, thereby realizing a current feedback control, making the output current equal or approximately equal to a constant value, further making the output voltage rise smoothly to a preset voltage value during the first phase of the startup process (preferably, the preset voltage value is slightly lower than the target voltage value).

Step S370: in the second phase of the startup process of the low dropout linear regulator, gradually turning off the current feedback loop, switching the voltage value of the voltage reference to the target value according to the second control signal, and generating the voltage reference according to the second control signal; preferably, providing a charging current to raise the second control signal to a high level state when a voltage value of the feedback voltage rises to the initial value; setting the voltage reference to be equal to the initial value when the second control signal is in a low level state, and setting the voltage reference to be equal to the target value when the second control signal is in a high level state, thereby making the output voltage raise to the target voltage value smoothly.

Preferably, a voltage stabilizing method for a low dropout linear regulator of a second embodiment of the disclosure further includes step S380 and step S390.

Step S380: providing an enable signal. When the enable signal is changed from inactive to active, the low dropout linear regulator begins to enter the first phase of the startup process; when the enable signal is inactive, step S390 is performed.

Step S390: resetting the second control signal to be in a low level state.

In each embodiment of the disclosure, by first providing a voltage reference less than or equal to an initial value during the startup process, and operating the low dropout linear regulator in current feedback mode, the low dropout linear regulator and the voltage stabilizing method limit the output current to prevent the output current from being too high and affect the load circuits in latter stages; at the same time, during the startup process, when the output voltage reaches a preset voltage value that is slightly lower than the target voltage value, the low dropout linear regulator and the voltage stabilizing method in each embodiment of the disclosure may be automatically switched to the voltage feedback mode by current feedback mode, and since the preset voltage value is close to the target voltage value, the output current generated by the low dropout linear regulator during the switching from the current feedback mode to the voltage feedback mode is limited, and the output voltage may gently rise from the preset voltage value to the target voltage value, so that the overshoot amplitude of the output voltage during the startup process is effectively controlled, and the load circuits in latter stages are prevented from being affected by the overshoot of the output voltage.

It is to be explained that the relationship terms, such as "first" and "second", are used herein only for distinguishing one entity or operation from another entity or operation but do not necessarily require or imply that there exists any actual relationship or sequence of this sort between these entities or operations. Furthermore, terms "comprising", "including" or any other variants are intended to cover the non-exclusive including, thereby making that the process, method, merchandise or device comprising a series of elements comprise not only those elements but also other elements that are not listed explicitly or the inherent elements to the process, method, merchandise or device. In the case of no more limitations, the element limited by the sentence "comprising a . . . " does not exclude that there exists another same element in the process, method, merchandise or device comprising the element.

The embodiments in accordance with the present disclosure, as described above, are not described in detail, and are not intended to limit the present disclosure to be only the described particular embodiments. Obviously, many modifications and variations are possible in light of the above. These embodiments has been chosen and described in detail by the specification to explain the principles and embodiments of the present disclosure so that those skilled in the art can make good use of the present disclosure and the modified use based on the present disclosure. The disclosure is to be limited only by the scope of the appended claims and the appended claims and equivalents thereof.

What is claimed is:

1. A low dropout linear regulator, comprising:

a drive circuit, configured to generate a first control signal according to a voltage difference between a voltage reference and a feedback voltage, and generate an output current according to the first control signal, wherein a load capacitor provides an output voltage according to the output current;

a voltage feedback circuit, configured to obtain the feedback voltage according to the output voltage;

a current feedback circuit, configured to generate a second control signal according to the output current; and a switch circuit, configured to provide the voltage reference according to the second control signal, wherein the current feedback circuit comprises a first transistor configured to provide a first current path between the first control signal and a reference ground, and a control terminal of the first transistor receives the second control signal, a startup process of the low dropout linear regulator comprises a first phase and a second phase, in the first phase, the voltage reference is less than or equal to an initial value, and a degree of conduction of the first transistor is controlled by the second control signal to adjust the first control signal in order to limit the output current, in the second phase, the first transistor is turned off by the second control signal, the switch circuit switches a voltage value of the voltage reference to a target value according to the second control signal, wherein the initial value is less than the target value.

2. The low dropout linear regulator according to claim 1, wherein in the drive circuit, the output current increases as a voltage of the first control signal increases.

3. The low dropout linear regulator according to claim 2, wherein the drive circuit comprises:

a differential amplifier, generating the first control signal according to a difference between the voltage reference and the feedback voltage;

a buffer unit, comprising at least a fourth transistor and a fifth transistor, a gate of the fifth transistor receiving a third control signal, the fourth transistor being configured to provide a third current path between the third control signal and the reference ground, a degree of conduction of the fourth transistor being controlled by the first control signal to adjust the third control signal; and a drive transistor, generating the output current according to the third control signal.

4. The low dropout linear regulator according to claim 3, wherein the fourth transistor comprises an N-channel transistor, and the fifth transistor comprises a P-channel transistor.

5. The low dropout linear regulator according to claim 1 wherein the first transistor comprises a P-channel transistor.

6. The low dropout linear regulator according to claim 5, wherein the current feedback circuit further comprises a current source, when a voltage value of the feedback voltage rises to the initial value, the current source provides a charging current to the control terminal of the first transistor to raise the second control signal to a high level state.

7. The low dropout linear regulator according to claim 5, wherein the switch circuit comprises:

a first switch and a second switch, a first terminal of the first switch and a second terminal of the second switch respectively receiving a first reference voltage and a second reference voltage, a second end of the first switch being connected to a second end of the second switch to provide the voltage reference, a voltage value of the first reference voltage and a voltage value of the second reference voltage being respectively equal to the initial value and the target value; and a logic circuit, configured to control the first switch and the second switch to be turned on and off according to the second control signal, wherein when the second control signal is in a low level state, the first switch is turned on and the second switch is turned off, and when the second control signal is in a high level state, the second switch is turned on and the first switch is turned off.

8. The low dropout linear regulator according to claim 7, wherein the logic circuit comprises: a latch, configured to generate a switch control signal according to an enable signal and a level state of the second control signal, wherein when the enable signal is active, one of the first switch and the second switch is turned on under the control of the switch control signal.

9. The low dropout linear regulator according to claim 8, wherein the low dropout linear regulator further comprises a reset circuit, the reset circuit comprising:

a hold capacitor, having a first end connected to the reference ground and a second end connected to the control terminal of the first transistor; and a reset transistor, turned on when the enable signal is inactive to short the first terminal and the second terminal of the hold capacitor.

10. The low dropout linear regulator according to claim 5, wherein the current feedback circuit further comprises:

a second transistor, configured to sample the output current to obtain a sampling current; and a third transistor, configured to provide a second current path between the second control signal and the reference ground, wherein a control terminal of the third transistor generates a sampling voltage according to the sampling current to cause a degree of conduction of the third transistor to be controlled by the sampling voltage.

11. The low dropout linear regulator according to claim 10, wherein the second transistor comprises a P-channel transistor, and the third transistor comprises an N-channel transistor.

12. The low dropout linear regulator according to claim 1, wherein the voltage feedback circuit comprises a plurality of sampling resistors connected in series, and the plurality of sampling resistors are configured to divide the output voltage to obtain the feedback voltage.

13. A voltage stabilizing method for a low dropout linear regulator, comprising:

generating a first control signal based on a voltage difference between a voltage reference and a feedback voltage;

generating an output current according to the first control signal;

providing an output voltage according to the output current;

providing a voltage feedback loop to obtain the feedback voltage according to the output voltage;

providing a current feedback loop to generate a second control signal according to the output current, wherein a first current path is provided between the first control signal and a reference ground; and providing the voltage reference according to the second control signal, wherein a startup process of the low dropout linear regulator comprises a first phase and a second phase, in the first phase, the current feedback loop is initiated, a voltage value of the voltage reference is set to be less than or equal to an initial value, and a degree of conduction of the first current path according to the second control signal to adjust a voltage of the first control signal in order to limit the output current, in the second phase, the current feedback loop is gradually turned off by turning off the first current path according to the second control signal, and a voltage value of the voltage reference is switched to a target value according to the second control signal, the initial value being less than the target value.

14. The voltage stabilizing method according to claim 13, wherein the output current is set to increase as a voltage of the first control signal raises.

15. The voltage stabilizing method according to claim 14, further comprising:

providing an enable signal;

resetting the second control signal to be in a low level state when the enable signal is inactive.

16. The voltage stabilizing method according to claim 14, wherein the step of generating a second control signal according to the output current comprises:

sampling the output current to obtain a sampling current, and obtaining a sampling voltage according to the sampling current;

providing a second current path between the second control signal and the reference ground, a degree of conduction of the second current path being controlled by the sampling voltage to adjust the second control signal.

17. The voltage stabilizing method according to claim 13, wherein the step of switching a voltage value of the voltage reference to a target value according to the second control signal comprises:

providing a charging current to raise the second control signal to a high level state when a voltage value of the feedback voltage rises to the initial value;

setting the voltage reference to be equal to the initial value when the second control signal is in a low level state, and setting the voltage reference to be equal to the target value when the second control signal is in a high level state.

18. The voltage stabilizing method according to claim 13, wherein the step of obtaining the feedback voltage according to the output voltage comprises:

dividing the output voltage to obtain the feedback voltage for characterizing the output voltage.

* * * * *